US010315824B2

(12) United States Patent
Holford

(10) Patent No.: US 10,315,824 B2
(45) Date of Patent: Jun. 11, 2019

(54) PACKAGE

(71) Applicant: Steven Holford, London (GB)

(72) Inventor: Steven Holford, London (GB)

(73) Assignee: BRITISH AMERICAN TOBACCO (INVESTMENTS) LIMITED, London (GB)

( * ) Notice: Subject to any disclaimer, the term of this patent is extended or adjusted under 35 U.S.C. 154(b) by 0 days.

(21) Appl. No.: 15/320,999

(22) PCT Filed: Jun. 30, 2015

(86) PCT No.: PCT/GB2015/051918

§ 371 (c)(1),
(2) Date: Dec. 21, 2016

(87) PCT Pub. No.: WO2016/001660

PCT Pub. Date: Jan. 7, 2016

(65) Prior Publication Data

US 2017/0152094 A1 Jun. 1, 2017

(30) Foreign Application Priority Data

Jul. 1, 2014 (GB) ..... 1411707.1

(51) Int. Cl.
*A24F 15/00* (2006.01)
*B65D 77/20* (2006.01)
(Continued)

(52) U.S. Cl.
CPC ..... *B65D 77/2024* (2013.01); *A24F 15/00* (2013.01); *B65B 61/18* (2013.01);
(Continued)

(58) Field of Classification Search
CPC ..... B65D 77/2024; B65D 85/1045; B65D 2577/2058; A24F 15/00; A24F 15/02; A24F 15/12
(Continued)

(56) References Cited

U.S. PATENT DOCUMENTS 4,280,653 A * 7/1981 Elias ..... B65D 3/22 229/123.1
4,300,676 A 11/1981 Focke
(Continued)

FOREIGN PATENT DOCUMENTS

DE 9208932 U1 11/1992
DE 102010015653 A1 11/2010
(Continued)

OTHER PUBLICATIONS

International Preliminary Report on Patentability for corresponding application PCT/CN2015/051920 filed Jun. 30, 2015; dated Jan. 2017.
(Continued)

*Primary Examiner* — Steven A. Reynolds
(74) *Attorney, Agent, or Firm* — Cantor Colburn LLP

(57) ABSTRACT

The present invention relates to packaging for tobacco industry products and, more particularly, packages comprising a label having a tab. A package comprises a barrier material for enclosing one or more tobacco industry products, the barrier material having a region which, in use, forms an aperture, and a label formed from two or more layers which overlie the region, the label having a tab formed from one or more layers, but not all layers, of the two or more layers of the label.

16 Claims, 7 Drawing Sheets

(51) Int. Cl.

| | |
|---|---|
| ***B65D 75/58*** | (2006.01) |
| ***B65D 85/10*** | (2006.01) |
| ***B65B 61/18*** | (2006.01) |
| ***B65C 3/06*** | (2006.01) |
| ***G09F 3/02*** | (2006.01) |
| ***G09F 3/10*** | (2006.01) |

(52) U.S. Cl.
CPC ..... *B65C 3/06* (2013.01); *B65D 75/5838* (2013.01); *B65D 85/1045* (2013.01); *G09F 3/02* (2013.01); *G09F 3/10* (2013.01); *B65D 2575/586* (2013.01); *B65D 2577/2058* (2013.01); *G09F 2003/0222* (2013.01); *G09F 2003/0257* (2013.01); *G09F 2003/0272* (2013.01)

(58) Field of Classification Search
USPC ..... 206/264, 242, 268
See application file for complete search history.

(56) References Cited

U.S. PATENT DOCUMENTS

| | | | | |
|---|---|---|---|---|
| 5,524,759 | A | 6/1996 | Herzberg | |
| 6,164,444 | A * | 12/2000 | Bray | B65D 75/5838 206/264 |
| 6,505,735 | B1 | 1/2003 | Parker | |
| 7,886,900 | B2 | 2/2011 | Weiss et al. | |
| 8,128,776 | B2 * | 3/2012 | Schuetz | B21D 51/44 156/250 |
| 8,740,052 | B2 * | 6/2014 | Drummond | B65D 77/2032 220/257.1 |
| 8,746,490 | B2 * | 6/2014 | Huffer | B32B 27/32 156/247 |
| 9,533,821 | B2 | 1/2017 | Buse | |
| 2002/0003143 | A1 * | 1/2002 | Grayer | B65D 77/2056 220/359.2 |
| 2002/0112982 | A1 | 8/2002 | Stagray | |
| 2003/0047470 | A1 | 3/2003 | Parker | |
| 2003/0164314 | A1 | 9/2003 | Bray | |
| 2004/0031706 | A1 | 2/2004 | Stringfield | |
| 2007/0235512 | A1 * | 10/2007 | Drummond | B65D 77/2032 229/123.1 |
| 2009/0071101 | A1 | 3/2009 | Bertuzzi | |
| 2010/0155273 | A1 | 6/2010 | Chatelain | |
| 2010/0230303 | A1 | 9/2010 | Buse | |
| 2010/0276311 | A1 | 11/2010 | Biondi | |
| 2011/0147443 | A1 | 6/2011 | Igo | |
| 2011/0226640 | A1 | 9/2011 | Bertuzzi | |
| 2011/0303567 | A1 * | 12/2011 | Bray | B65D 75/5838 206/265 |
| 2012/0006823 | A1 | 1/2012 | Bertuzzi | |
| 2012/0241339 | A1 | 9/2012 | Buse | |
| 2013/0319886 | A1 | 12/2013 | Ledermann | |

FOREIGN PATENT DOCUMENTS

| | | | |
|---|---|---|---|
| EP | 2284095 | A1 | 2/2011 |
| GB | 396570 | | 8/1933 |
| GB | 2451180 | A | 1/2009 |
| WO | 2010066543 | A1 | 6/2010 |
| WO | 2012095135 | A1 | 7/2012 |
| WO | 2012120273 | A1 | 9/2012 |
| WO | 2013053408 | A1 | 4/2013 |

OTHER PUBLICATIONS

International Preliminary Report on Patentability for corresponding application PCT/GB2015/051918 filed Jun. 30, 2015; dated Jan. 12, 2017.
International Search Report for corresponding application PCT/GB20151051918 filed Jun. 30, 2015; dated Aug. 28, 2015.
International Search Report for corresponding application PCT/GB20151051920 filed Jun. 30, 2015; dated Nov. 4, 2015.
Written Opinion of the ISA for corresponding application PCT/GB2015/051918 filed Jun. 30, 2015; dated Aug. 28, 2015.
Written Opinion of the ISA for corresponding application PCT/GB2015/051920 filed Jun. 30, 2015; dated Nov. 4, 2015.

* cited by examiner

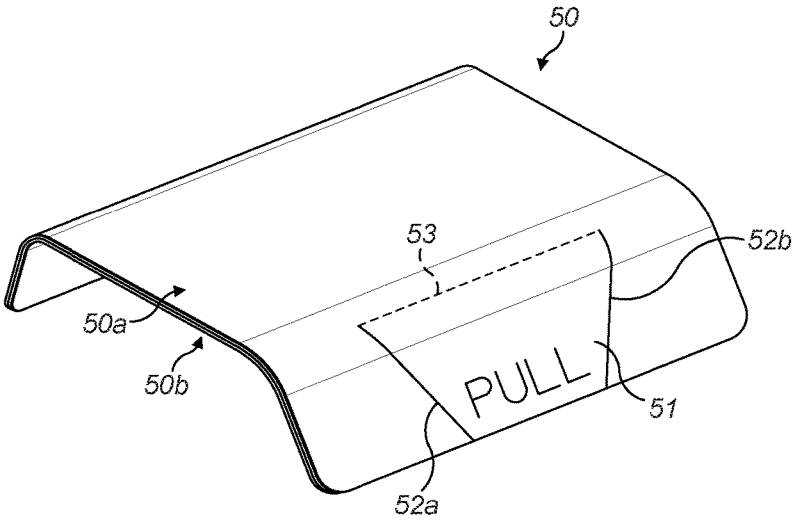
FIG. 3(c)
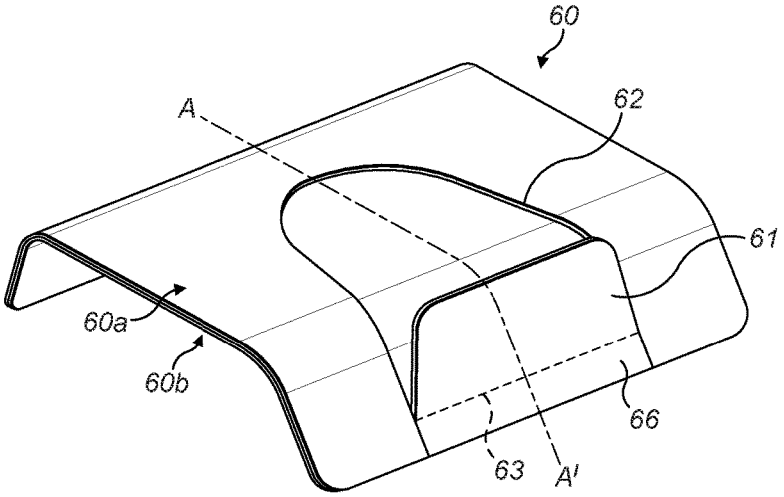
FIG. 3(d)(i)
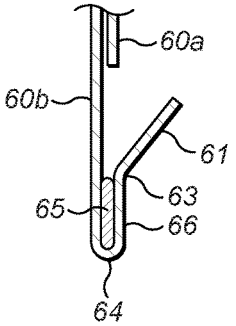
FIG. 3(d)(ii)

PACKAGE

CROSS REFERENCE TO RELATED APPLICATIONS

This application is related to U.S. Patent Application Serial Number (not yet available) entitled "A Package" filed on Dec. 21, 2016 under 35 USC 371 as the U.S. national stage of International Patent Application Number PCT/GB2015/051920 filed on Jun. 30, 2015 which claims priority to United Kingdom Patent Application Number GB1411708.9 filed on Jul. 1, 2014, all of which said applications are herein cross referenced and incorporated by reference in their entirety.

TECHNICAL FIELD

The present invention relates to a package for tobacco industry products and, particularly but not exclusively, to a package comprising a label having a tab. The invention also relates to a method of producing a package.

BACKGROUND

It is known to provide a label for resealing an access opening in a cigarette pack and for the label to have a pull tab for the user to grasp when using the label. The label may be provided with a permanently tacky adhesive on its under surface to releasably adhere the label to the cigarette pack such that it covers the access opening.

SUMMARY

According to embodiments of the invention from a first aspect, there is provided a package comprising a barrier material for enclosing one or more tobacco industry products, the barrier material having a region which, in use, forms an aperture and a label formed from two or more layers which overlie the region, the label having a tab formed from one or more layers, but not all layers, of the two or more layers of the label.

The tab can be formed from one or more layers, but not all layers, of the two or more layers of the label and can be arranged to overlie the remaining layer(s) of the two or more layers of the label.

The label can be integrally formed and/or the label can be resealable.

The region can be formed by one or more lines of weakness and the two or more layers of the label can each overlie the one or more lines of weakness.

The tab can be connected to the label at a point on the label overlying the region.

The tab can be arranged to fully overlie the region.

The tab can extend parallel to a first face of the package and towards a second face of the package.

The tab can extend beyond an edge formed by the first and second faces of the package.

The tab can be formed by at least one cut in the label.

The at least one cut can extend at each side of the tab in a first direction and on termination can have a direction substantially opposite the first direction.

The layers of the label can be adhered to each other except for the under side of the tab and the surface of the layer over which the tab lies when lying flat against the label.

The tab can be arranged to extend partially or completely into a cut-out portion formed in the label.

A region of the label within the cut-out portion can be free of adhesive.

At least a portion of the label can be removable from the package.

A portion of the label can be permanently connected to the barrier material.

The label can comprise a permanently tacky adhesive on at least a portion of the under surface of the label.

According to embodiments of the invention from a second aspect, there is provided a container for tobacco industry products comprising a body, a lid and containing a package as set out above, wherein the package is enclosed by the body and the lid and wherein the lid is arranged to catch and fold the tab upon closure.

According to embodiments of the invention from a third aspect, there is provided a method of producing a package, the method comprising forming a label from two or more layers, forming a tab from one or more layers, but not all layers, of the two or more layers of the label and adhering the label to a barrier material, the label being arranged to overlie a region of the barrier material which, in use, forms an aperture.

According to embodiments of the invention from a fourth aspect, there is provided a label for covering an aperture in a barrier material for enclosing one or more tobacco industry products, the label being formed from two or more layers and having a tab formed from one or more layers, but not all layers, of the two or more layers of the label.

BRIEF DESCRIPTION OF THE DRAWINGS

Embodiments of the present invention will now be described, by way of example only, with reference to the accompanying drawings, in which:

FIG. 3(*b*) is a perspective view of a label for use with packages described herein, the label formed from first and second layers and including a tab formed from a portion of the first layer extending across the width of the label at the lower edge of the label;

FIG. 3(*c*) is a perspective view of a label for use with packages described herein, the label formed from first and second layers and including a tab formed from a portion of the first layer extending partly across the width of the label at the lower edge of the label;

FIG. 3(*d*)(*i*) is a perspective view of a label for use with packages described herein, the label formed from first and second layers and including a tab formed from material of the second layer which is folded back onto itself and into a recess formed by a cut-out in the first layer;

FIG. 3(*d*)(*ii*) is a schematic cross-sectional view of the label of FIG. (3)(*d*)(*i*) taken along line A-A' of FIG. (3)(*d*)(*i*);

FIG. 3(*e*) is a perspective view of a label for use with packages described herein, the label formed from first and second layers and including a tab formed from the first layer and extending from the lower edge of the label;

FIG. 3(*f*) is a perspective view of a label for use with packages described herein, the label formed from first and second layers and including a tab formed from the first layer extending partially into a recess formed by a cut out in the first layer;

DETAILED DESCRIPTION

The present invention relates to packaging for tobacco industry products. A tobacco industry product refers to any item made in, or sold by the tobacco industry, typically including a) cigarettes, cigarillos, cigars, tobacco for pipes or for roll-your-own cigarettes, (whether based on tobacco, tobacco derivatives, expanded tobacco, reconstituted tobacco or tobacco substitutes); b) non-smoking products incorporating tobacco, tobacco derivatives, expanded tobacco, reconstituted tobacco or tobacco substitutes such as snuff, snus, hard tobacco, and heat-not-burn products; and c) other nicotine-delivery systems such as e-cigarettes, inhalers, lozenges and gum. This list is not intended to be exclusive, but merely illustrates a range of products which are made and sold in the tobacco industry.

The present invention relates, in some examples, to packaging for smoking articles. As used herein, the term "smoking article" includes smokeable products such as cigarettes, cigars and cigarillos whether based on tobacco, tobacco derivatives, expanded tobacco, reconstituted tobacco or tobacco substitutes and also heat-not-burn and e-cigarette or other nicotine delivery products but is not limited thereto. The smoking article may be provided with a filter for the gaseous flow drawn by the smoker.

Figure 1:
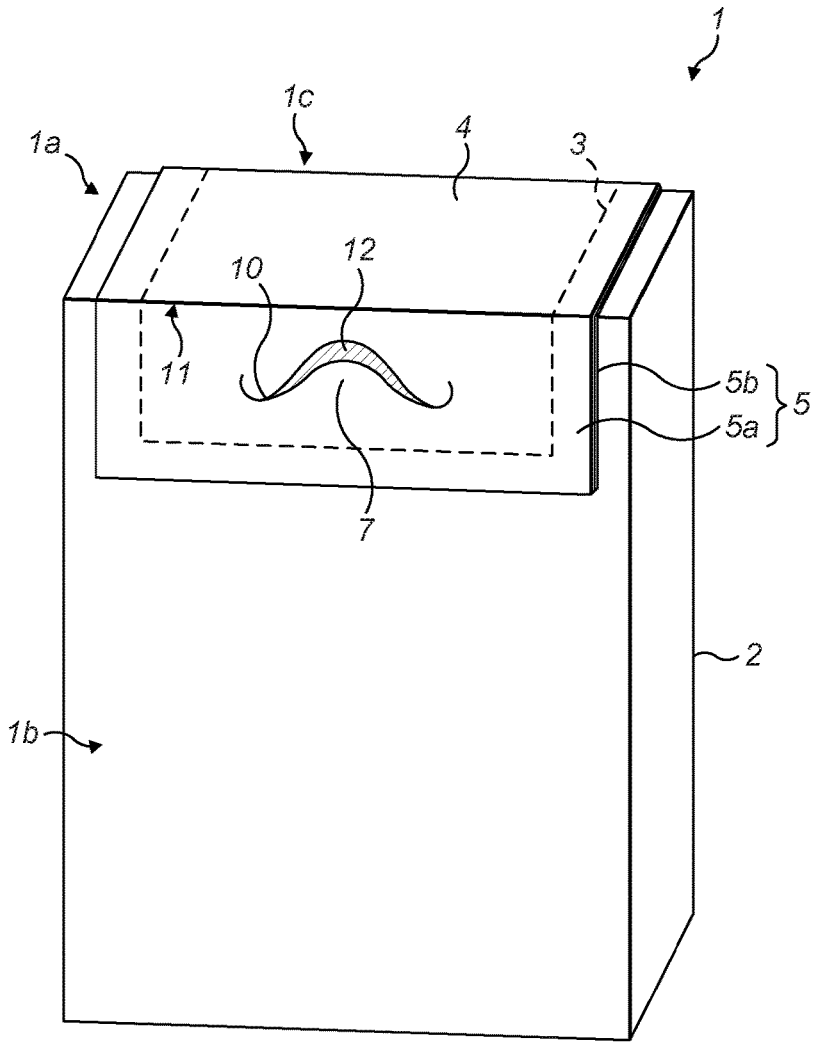
FIG. 1 is a perspective view of a package for smoking articles the package having a label formed from multiple layers and including a tab formed from at least one of the layers extending upwardly from a front face of the label.

FIG. 1 is a perspective view of a package 1 for tobacco industry products, in the present example for smoking articles. The package 1 includes a barrier material 2 for containing the smoking articles and which provides a sealed enclosure around the smoking articles. The barrier material 2 has a line of weakening 3 which defines a region 4 of the pack which, in use, forms an aperture through which smoking articles can be removed.

In the present example, the region 4 extends over a top face is and a front face 1*b* of the package 1. The region 4 may extend over a single face of the package 1 or over more than one face of the package 1, for instance two, three or more faces of the package 1. The line of weakening 3 is substantially 'U' shaped in the present example, although in alternative examples can form a complete loop.

In the present example, the aperture is resealably closed by a label 5. The label 5 is formed from two or more layers which overlie the region 4. In particular, in the present example the label 5 is formed from two layers, a first layer 5*a* forming the side of the label 5 facing away from the barrier material 2 and a second layer 5*b* forming the side of the label 5 facing the barrier material 2. The label 5 includes a tab 7 formed from one of the layers of the label 5, the first layer 5*a* in the present example. In examples in which the label 5 is made from more than two layers, the tab 5 can be formed from one or more layers, but not all layers, of the three or more layers of the label 5. The tab 7 is, in the present example, arranged to overlie the remaining layer(s) of the label 5 when folded flat to lie against the label 5. The label 5 includes a permanently tacky adhesive on its under surface which adheres to the barrier material 2.

The tab 7 overlies the region 4 defined by line of weakening 3. The tab 7 extends from the label 5 at a point on the label 5 overlying the region 4, although in alternative examples the tab 7 may extend from the label 5 at a point on the label 5 that does not overlie the region 4.

The tab 7 is formed from a cut made in the first layer 5*a* only, such that when the tab 7 is pulled forwards, a region 12 of the second layer 5*b* is exposed beneath the tab 7. The first and second layers 5*a*, 5*b* of the label 5 are adhered together by adhesive applied between the layers except for in the region beneath the tab 7, which is free of adhesive enabling the tab 7 to be pulled away from the second layer 5*b*.

The tab 7 is arranged so as to allow it to be conveniently grasped by a user. For instance, the tab 7 is arranged to enable the user to grasp the tab to open the label 5 and reveal the aperture in order to remove a smoking article. The periphery 10 of the tab 7 is curved in the present example, forming a substantially semi-circular shape, although other shapes can also be used, such as a substantially triangular, square, elliptical or rectangular shape.

The cut, at each side of the tab 7, extends initially in a first direction, in the present example substantially downwards towards the base of the package 1, and on termination is directed substantially in an opposite direction, in the present example upwards towards the top face is of the package 1. Arranging the cut to have this geometry results in an increased resistance to tearing of the label 5 at the edges of the tab 7 when the tab 7 is grasped and pulled. When the tab 7 is grasped and pulled, a downward force is exerted on the portions of the resealabel label 5 adjacent to the tab 7. Arranging the cut, at each side of the tab 7, to extend initially in a first direction and on termination to be directed substantially in an opposite direction, causes the pressure exerted on the aforementioned portions of the resealabel label 5 to be dissipated over a larger part of the label 5 and therefore increases the resistance of the label 5 to tearing.

The package 1 can be arranged to be provided within an outer container (not shown in FIG. 1), for instance a rigid cardboard container such as a hinge-lid cigarette container.

The label 5 is in the form of a flap having a portion (not shown) extending onto the rear face is of the package 1 which is permanently adhered to the barrier material 2. The label 5 has permanently tacky adhesive covering the remainder of its under surface which, within the region 4, adheres the label 5 permanently to the barrier material 2 and, on portions of the label 5 which extend outwardly of the region 4, releasably attach the label 5 to the barrier material 2, forming a seal around the region 4. In alternative examples of the invention, the label 5 may have permanent adhesive connecting the label 5 to the region 4 of barrier material 2, rather than permanently tacky adhesive. Also, all or part of the label 5 may be removable from the barrier material 2 altogether, for instance by providing a line of perforations across the label 5 enabling a portion to be removed, or by using only permanently tacky adhesive to adhere the label 5 to the barrier material 2 outside of the region 4, such that the complete label 5 can be removed.

The tab 7 extends from the portion of the label 5 overlying the front face 1*b* of the package 1, and projects towards the portion of the label 5 overlying the top face is of the package 1. Alternatively, the tab 7 may extend from the portion of the label 5 overlying any first face of the package and project in any direction, for instance towards any second face of the package. For example, the tab 7 may extend from the portion of the label 5 overlying the top face of the package 1 and project towards the portion of the label 5 overlying the front face of the package 1. The tab 7 may extend from any portion of the label 5/package 1 and project towards any other portion of the label 5/package 1.

Figure 5:
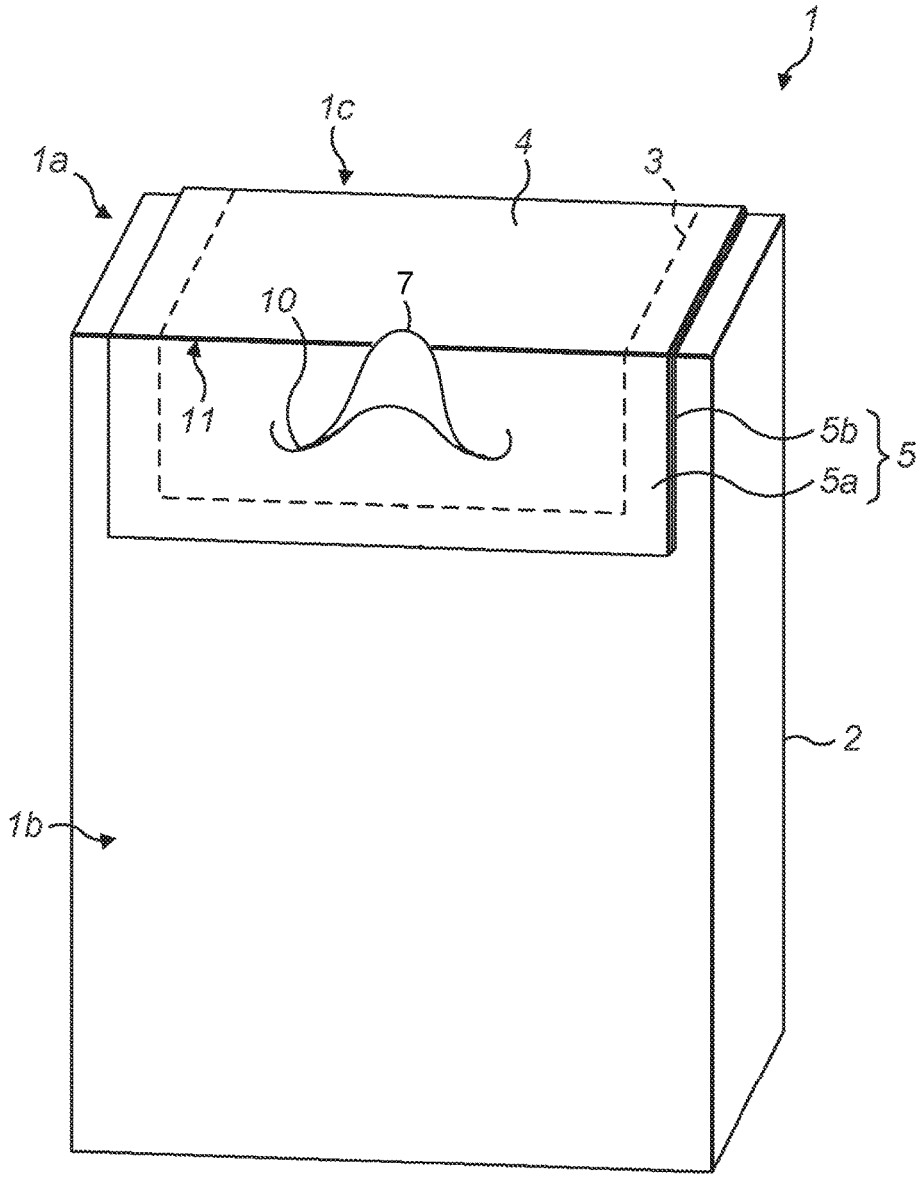
FIG. 5 is a perspective view of a package for smoking articles, the package having a tab extending beyond an edge formed by the first and second faces of the package.

In the present example, as seen in FIG. 5, the tab 7 extends beyond the edge 11 formed from the adjoining top and front faces 1*a*, 1*b* of the package 1. This enables the tab 7 to be more easily grasped than a tab which does not extend beyond such an edge 11, since a portion of the rear of the tab 7 is exposed allowing the tab 7 to be pulled forwards as it is grasped. Alternatively, the tab 7 may abut or terminate before reaching the edge 11 formed from the adjoining front and top faces. The tab 7 may extend beyond, abut, or terminate before the edge formed from any two adjoining first and second faces of the package 1 on which the label 5 is located.

The exterior surface of the tab 7 and/or label 5 may have a printed logo or writing.

The barrier material 2 and/or label 5 may be made from a material such as a metallised plastic or a plastics/metal foil laminate. The barrier material 2 and label 5 may be made from the same material or different materials. The barrier material 2 and/or label 5 may comprise a material which is transparent or opaque.

Figure 2:
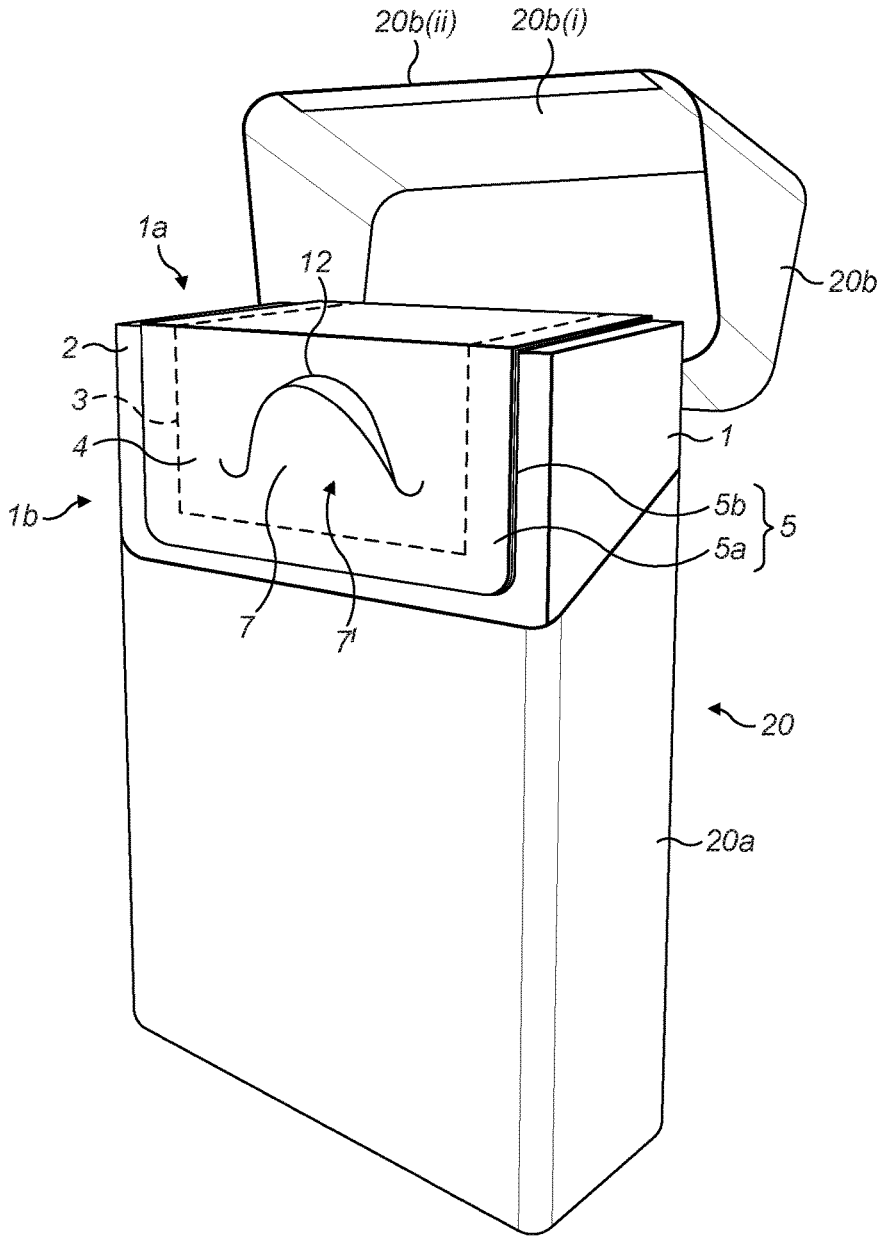
FIG. 2 is a perspective view of a container enclosing a package for smoking articles, the package having a label formed from multiple layers and including a tab formed from at least one of the layers extending upwardly from a front face of the label.
Figure 3A:
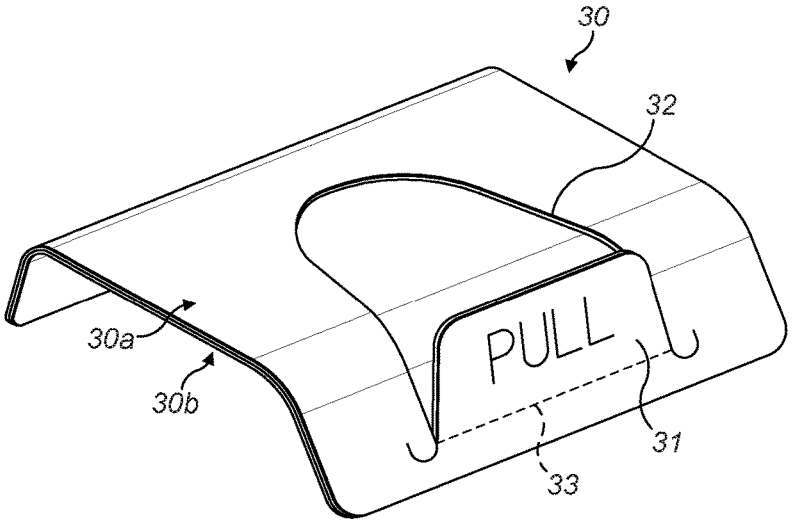
FIG. 3(*a*) is a perspective view of a label for use with packages described herein, the label formed from first and second layers and including a tab formed from the first layer extending partially into a recess formed by a cut out in the first layer.
Figure 3B:
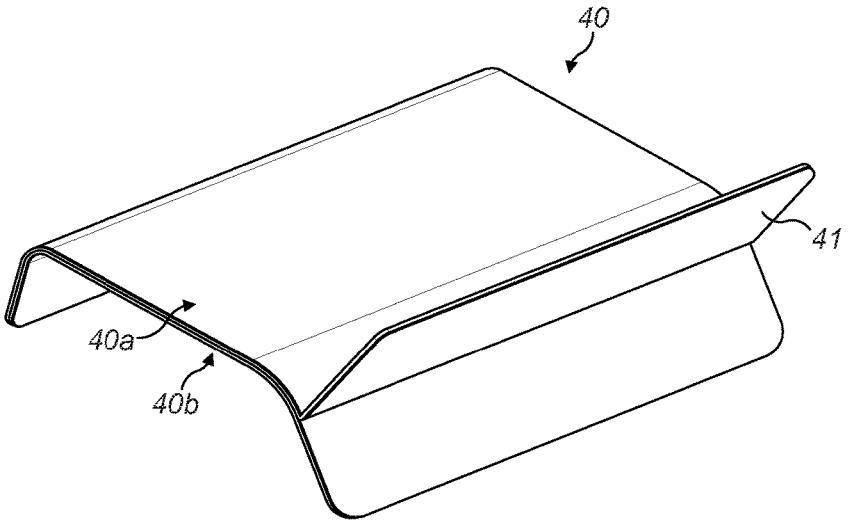
Figure 3E:
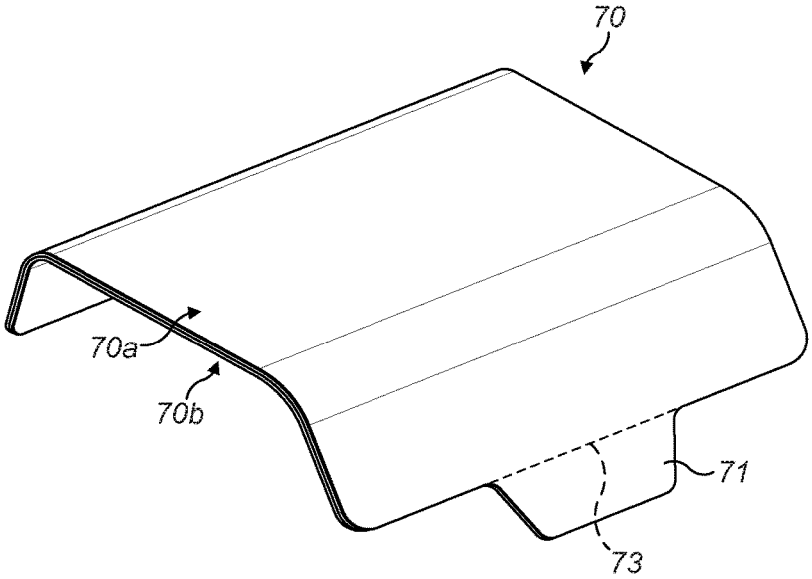
Figure 3F:
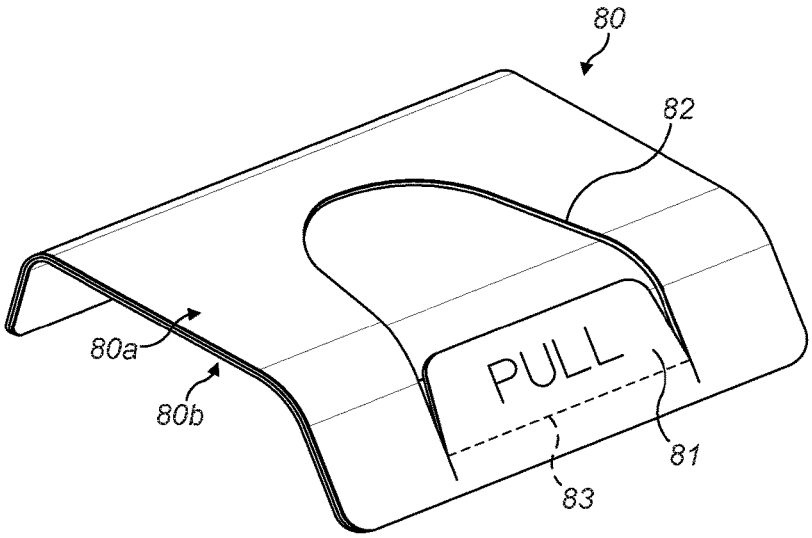

FIG. 2 is perspective view of a container 20 enclosing a package 1 for smoking articles as illustrated with reference to FIG. 1. The package 1 is disposed within the container 20 which comprises a body 20*a* and a lid 20*b* hingedly connected to the body 20*a*. The container 20 may be formed from a blank, and may be made of card, or of a similar foldable material. The container 20 may be overwrapped with a removable layer, for example cellophane.

The tab 7 is connected to the label 5 in a region 7' and from that region extends upwardly towards the top of the package 1. The region 7' at which the tab 7 is connected to the label 5 overlies the region 4 of the barrier material 2 defined by the line of weakening.

Prior to the user first opening the container 20, the lid 20*b* is closed onto the container body 20*a* and the tab 7 can be folded back over the label 5 and held in position by the front wall 20*b*(*i*) of the lid 20*b*. In this initial state, the undersurface of the tab 7 faces outwards and the tab 7 extends towards the container body 20*a*.

When extracting a smoking article for the first time, the user firstly opens the lid 20*b* to reveal the tab 7. The tab 7 will unfold and project at an angle from the front face 1*b* of the package 1. The tab 7 may project at an angle between 5° and 120° from the front face 1*b* of the package 1. For example, the tab 7 may project at an angle of about 30° from the front wall.

In order to close container and reseal the package 1 the user simply closes the lid 20*b*. In the present example, the lid 20*b* is arranged to catch and fold the tab 7 back on itself upon closure. As the lid 20*b* closes, it pushes the label 5 towards the barrier material 2, causing the permanently tacky adhesive on the undersurface of the label 5 to re-adhere the label 5 to the barrier material 2. The lower edge 20*b*(*ii*) of front wall 20*b*(*i*) of the lid 20*b* engages with the undersurface of tab 7 and re-folds the tab 7 back to its initial state.

Arranging the lid 20*b* to catch and fold the tab 7 as the lid 20*b* closes advantageously results in the tab 7, upon subsequent openings of the container 20, becoming unfolded and projecting at an angle from the front face 1*b* of the package 1. The tab 7 is therefore displayed clearly to the user each time the container is re-opened and the user can easily grasp the tab 7 to open the label 5.

The container may contain two separate enclosures, each containing a charge of smoking articles and each having an independent label having a tab.

FIG. 3(*a*) is a perspective view a label 30 for use in place of the labels described herein for use with the packages described herein. The label 30 is formed from a first layer 30*a* which is arranged to be on the outer side of the label 30 when applied to a package as described herein, and a second layer 30*b* arranged to be on the inner side of the label 30, facing the package, when applied to a package as described herein. A tab 31 is formed from a portion of the first layer 30*a* and, when lying flat, extends partially into a recess formed by a cut out 32 in the first layer 30*a*. The first and second layers 30*a*, 30*b* of the label 30 of FIG. 3(*a*) are adhered together by adhesive applied across their adjacent surfaces except in the region surrounded by the cut out 32 and the region underlying the tab 31, where no adhesive is applied. A line of weakness 33 such as a score line, partial cut or the like is provided at the edge of the tab 31 where the tab 31 meets the remainder of the label 30, to facilitate lifting the tab 31 up and away from the label 30 when it is grasped. The under surface of the label 30 can be provided with a resealable permanently tacky adhesive for use in resealing the label 30 over the aperture of the package to which it is applied, as described hereinbefore.

Forming the tab 31 such that it extends partially and not completely into a recess formed in the label 30 has the advantage that the tab 31 is easier to grasp by users, who can slide a finger along the back face of the recess and then behind the tab 31, enabling the tab 31 to be lifted.

The label 30 can be used to resealably close packages comprising a barrier material having a region defined by a line of weakening which, in use, forms an aperture through which smoking articles can be removed, such as packages described in the above examples. The label 30 is arranged to at least partially overlie the region of such packages. The tab 31 is connected to the label 30 at a position on the label 30 which, in use, would overlie the region 4.

In the present example, the tab 31 is formed from a cut in the label 30. The cut, at each side of the tab 31, extends initially in a first direction, in the present example substantially downwards towards a lower edge of the label, and on termination is directed substantially in an opposite direction, in the present example upwards towards a top edge of the label 30. As described with reference to FIG. 1, arranging the cut to have this geometry, as shown in FIG. 3(*a*), results in an increased resistance to tearing of the label 30 at the edges of the tab 31 when the tab 31 is grasped and pulled.

FIG. 3(*b*) is a perspective view a label 40 for use in place of the labels described herein for use with the packages described herein. The label 40 is formed from a first layer 40*a* which is arranged to be on the outer side of the label 40 when applied to a package as described herein, and a second layer 40*b* arranged to be on the inner side of the label 40, facing the package, when applied to a package as described herein. A tab 41 is formed from a portion of the first layer 40*a* arranged at an edge of the label 40 and extending across the width of the label 40.

The first and second layers 40*a*, 40*b* of the label 40 of FIG. 3(*b*) are adhered together by adhesive applied across their adjacent surfaces except in the region underlying the tab 41, where no adhesive is applied enabling the tab 41 to be lifted. A line of weakness such as a score line, partial cut or the like is provided at the edge of the tab 41 where the tab 41 meets the remainder of the label 40, to facilitate lifting the tab 41 up and away from the label 40 when it is grasped. The under surface of the label 40 can be provided with a resealable permanently tacky adhesive for use in resealing the label over the aperture of the package to which it is applied, as described hereinbefore.

The label 40 can be used to resealably close packages comprising a barrier material having a region defined by a line of weakening which, in use, forms an aperture through which smoking articles can be removed, such as packages described in the above examples. The label 40 is arranged to at least partially overlie the region of such packages. The tab 41 is connected to the label 40 at a position on the label 40 which, in use, would overlie the region 4.

FIG. 3(*c*) is a perspective view a label 50 for use in place of the labels described herein for use with the packages described herein. The label 50 is formed from a first layer 50*a* which is arranged to be on the outer side of the label 50 when applied to a package as described herein, and a second layer 50*b* arranged to be on the inner side of the label 50, facing the package, when applied to a package as described herein. A tab 51 is formed from a portion of the first layer 50*a* arranged at an edge of the label 50 and extending partially across the width of the label 50. In the present example, the tab 51 is substantially trapezoidal in shape, although other shapes can be used. The tab 51 is formed by first and second cuts 52*a*, 52*b* through the thickness of the first layer 50*a* and which do not extend into the second layer sob.

The first and second layers 50*a*, sob of the label 50 of FIG. 3(*c*) are adhered together by adhesive applied across their adjacent surfaces except in the region underlying the tab 51, where no adhesive is applied enabling the tab 51 to be lifted. A line of weakness 53 such as a score line, partial cut or the like is provided at the edge of the tab 51 where the tab 51 meets the remainder of the label 50, to facilitate lifting the tab 51 up and away from the label 50 when it is grasped. The under surface of the label 50 can be provided with a resealable permanently tacky adhesive for use in resealing the label over the aperture of the package to which it is applied, as described hereinbefore.

The label 50 can be used to resealably close packages comprising a barrier material having a region defined by a line of weakening which, in use, forms an aperture through which smoking articles can be removed, such as packages described in the above examples. The label 50 is arranged to at least partially overlie the region of such packages. The tab 51 is connected to the label 50 at a position on the label 50 which, in use, would overlie the region 4.

FIG. 3(*d*)(*i*) is a perspective view a label 60 for use in place of the labels described herein for use with the packages described herein. The label 60 is formed from a first layer 60*a* which is arranged to be on the outer side of the label 60 when applied to a package as described herein, and a second layer 60*b* arranged to be on the inner side of the label 60, facing the package, when applied to a package as described herein, except for a portion forming the a tab 61. The tab 61 is formed from a portion of the second layer 60*b*, extending partially across the width of the label 60, which is folded back on itself and into a recess formed by a cut out 62 formed in the first layer 60*a*. In the present example, the tab 61 is substantially trapezoidal in shape, although other shapes can be used.

FIG. 3(*d*)(*ii*) is a schematic cross-sectional view of the label 60 of FIG. (3)(*d*)(*i*) taken along line A-A' of FIG. (3)(*d*)(*i*). As illustrated, a portion of material extending from the second layer 60*b* of the label is folded along a fold line 64 and adhered using adhesive 65 onto itself in a region 66. A line of weakness 63 such as a score line, partial cut or the like is provided at the edge of the tab 61 where the tab 61 meets the region 66, to facilitate lifting the tab 61 up and away from the label 60 when it is grasped.

The first and second layers 60*a*, 60*b* of the label 60 of FIG. 3(*d*)(*i*) are adhered together by adhesive applied across their adjacent surfaces except in the region surrounded by the cut out 62, and underlying the tab 61, where no adhesive is applied enabling the tab 61 to be lifted. The under surface of the label 60 can be provided with a resealable permanently tacky adhesive for use in resealing the label over the aperture of the package to which it is applied, as described hereinbefore.

The label 60 can be used to resealably close packages comprising a barrier material having a region defined by a line of weakening which, in use, forms an aperture through which smoking articles can be removed, such as packages described in the above examples. The label 60 is arranged to at least partially overlie the region of such packages. The tab 61 is connected to the label 60 at a position on the label 60 which, in use, would overlie the region 4.

FIG. 3(*e*) is a perspective view of a label 70 for use in place of the labels described herein for use with packages described herein. The label 70 is formed from a first layer 70*a* which is arranged to be on the outer side of the label 70 when applied to a package as described herein, and a second layer 10*b* arranged to be on the inner side of the label 70, facing the package, when applied to a package as described herein. A tab 71 is formed from the first layer 70*a* only and extends from the lower edge of the label 70, as shown in FIG. 3(*e*). The first and second layers 70*a*, 70*b* of the label 70 of FIG. 3(*e*) are adhered together by adhesive applied across their adjacent surfaces. A line of weakness 73 such as a score line, partial cut or the like is provided at the edge of the tab 71 where the tab 71 meets the remainder of the label 70, to facilitate folding the tab 71 back onto the outer surface of the label 70. The under surface of the label 70 can be provided with a resealable permanently tacky adhesive for use in resealing the label over the aperture of the package to which it is applied, as described hereinbefore.

The label 70 can be used to resealably close packages comprising a barrier material having a region defined by a line of weakening which, in use, forms an aperture through which smoking articles can be removed, such as packages described in the above examples. The label 70 is arranged to at least partially overlie the region defined by the line of weakness of such packages.

FIG. 3(*f*) is a perspective view of a label 80 for use in place of the labels described herein for use with packages described herein. The label 80 is formed from a first layer 80*a* which is arranged to be on the outer side of the label 80 when applied to a package as described herein, and a second layer 80*b* arranged to be on the inner side of the label 80, facing the package, when applied to a package as described herein. A tab 81 is formed from a portion of the first layer 80*a* and, when lying flat, extends partially into a recess formed by a cut out 82 in the first layer 80*a*. The first and second layers 80*a*, 80*b* of the label 80 of FIG. 3(*f*) are adhered together by adhesive applied across their adjacent surfaces except in the region surrounded by the cut out 82 and the region underlying the tab 81, where no adhesive is applied. The under surface of the label 80 can be provided with a resealable permanently tacky adhesive for use in resealing the label over the aperture of the package to which it is applied, as described hereinbefore.

A line of weakness 83 such as a score line, partial cut or the like is provided at the edge of the tab 81 where the tab 81 meets the remainder of the label 80, to facilitate lifting the tab 81 up and away from the label 80 when it is grasped.

In the present example, the tab 81 is formed from a cut in the label 80. The cut, at each side of the tab 81, extends substantially downwards into the label 80 and terminates at a position above the lower edge of the label 80. Arranging the cut in this way, as shown in FIG. 3(*f*), reduces the likelihood of the label 80 tearing at the edges of the tab 81 when the tab 81 is grasped and pulled.

The label 80 can be used to resealably close packages comprising a barrier material having a region defined by a line of weakening which, in use, forms an aperture through which smoking articles can be removed, such as packages described in the above examples. The label 80 is arranged to at least partially overlie the region of such packages. The tab 81 is connected to the label 80 at a position on the label 80 which, in use, would overlie the region 4.

Figure 4:
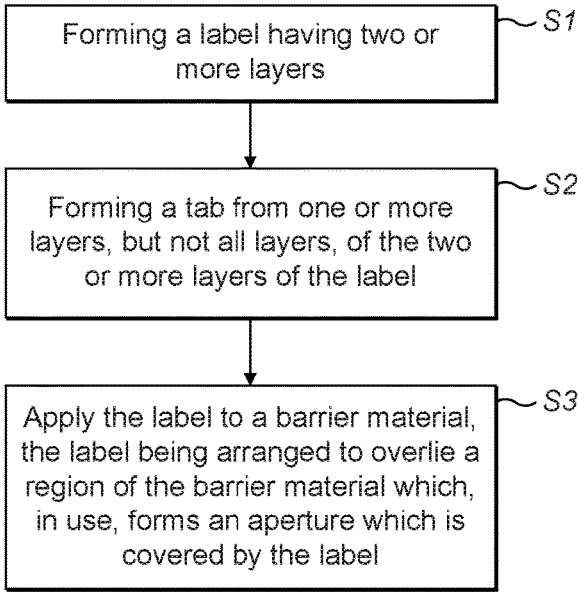
FIG. 4 is a flow diagram illustrating a method for forming packages as described herein.

FIG. 4 is a flow diagram showing a method for forming packages in accordance with examples of the present invention. In a first step S1 a label is formed having two or more layers. In a second step S2 a tab if formed from one or more layers, but not all layers, of the two or more layers of the label. For instance, a multilayered laminate material can be provided and a cut out made in one or more layers to form a label as described herein. In a third step S3 the label is applied to a barrier material, the label being arranged to overlie a region of the barrier material which, in use, forms an aperture which is covered by the label.

Although the examples described above disclose resealable labels, alternative examples may have labels that are not resealable. In such examples, at least a portion of the undersurface of the label may be provided with a dry adhesive to adhere the label to a barrier material. After the label has been removed from the barrier material for a first time, the dry adhesive loses its tacky characteristic and the label can not be re-adhered to the barrier material.

In order to address various issues and advance the art, the entirety of this disclosure shows by way of illustration various examples in which the claimed invention(s) may be practiced and provide for superior packaging for tobacco industry products. The advantages and features of the disclosure are of a representative sample of examples only, and are not exhaustive and/or exclusive. They are presented only to assist in understanding and teach the claimed features. It is to be understood that advantages, examples, examples, functions, features, structures, and/or other aspects of the disclosure are not to be considered limitations on the disclosure as defined by the claims or limitations on equivalents to the claims, and that other examples may be utilised and modifications may be made without departing from the scope and/or spirit of the disclosure. Various examples may suitably comprise, consist of, or consist essentially of, various combinations of the disclosed elements, components, features, pails, steps, means, etc. In addition, the disclosure includes other inventions not presently claimed, but which may be claimed in future.

The invention claimed is:

1. A package comprising:

a barrier material for enclosing one or more tobacco industry products, the barrier material having a region defined by one or more lines of weakening in the barrier material which, in use, forms an aperture; and a label formed from two or more layers which overlie the region, the label having a tab formed from one or more layers, but not all layers, of the two or more layers of the label; and wherein the two or more layers of the label extend beyond the one or more lines of weakening in the barrier material that define the region and wherein the underside of the portion of the label extending beyond the one or more lines of weakening is provided with permanently tacky adhesive to adhere the label to the barrier material outside of the region.

2. A package according to claim 1, wherein the tab is arranged to overlie the remaining layer(s) of the two or more layers of the label.

3. A package according to claim 1, wherein the two or more layers of the label are integrally formed.

4. A package according to claim 1, wherein the label is resealable.

5. A package according to claim 1, wherein the tab is connected to the label at a point on the label overlying the region.

6. A package according to claim 1, wherein the tab fully overlies the region.

7. A package according to claim 1, wherein the tab extends parallel to a first face of the package and towards a second face of the package.

8. A package according to claim 7, wherein the tab extends beyond an edge formed by the first and second faces of the package.

9. A package according to claim 1, wherein the tab is formed by at least one cut in the label.

10. A package according to claim 9, wherein the at least one cut extends at each side of the tab in a first direction and on termination has a direction substantially opposite the first direction.

11. A package according to claim 10, wherein the layers of the label are adhered to each other except for an under side of the tab and the surface of the layer over which the tab lies when lying flat against the label.

12. A package according to claim 1, wherein the tab is arranged to extend partially or completely into a cut-out portion formed in the label.

13. A package according to claim 12, wherein a region of the label within the cut-out portion is free of adhesive.

14. A package according to claim 1, wherein at least a portion of the label is removable from the package.

15. A package according to claim 1, wherein a portion of the label is permanently connected to the barrier material.

16. A container for tobacco industry products comprising a body, a lid and containing a package according to claim 1, wherein the package is enclosed by the body and the lid and wherein the lid is arranged to catch and fold the tab upon closure.

* * * * *